US005572831A

United States Patent [19]

Rafiqui

[11] Patent Number: 5,572,831

[45] Date of Patent: Nov. 12, 1996

[54] LOUVER ASSEMBLY WITH COVER AND CAP

[75] Inventor: Lisa A. Rafiqui, Coppell, Tex.

[73] Assignee: Let's Rollit LLC, Coppell, Tex.

[21] Appl. No.: 399,756

[22] Filed: Mar. 7, 1995

[51] Int. Cl.[6] ..... E06B 7/08

[52] U.S. Cl. ..... 49/403; 49/92.1; 160/236; 160/900

[58] Field of Search ..... 49/403, 92.1; 160/236, 160/900, 166.1 R, 166.1 V, 178.1 R, 178.1 V

[56] References Cited

U.S. PATENT DOCUMENTS

| | | | |
|---|---|---|---|
| 268,847 | 12/1882 | Adamson | 49/403 |
| 2,074,482 | 3/1937 | Martens | 160/236 |
| 2,217,217 | 10/1940 | Engstrom | 160/236 X |
| 2,326,454 | 8/1943 | Gentile | 160/236 |
| 4,027,430 | 6/1977 | Sakamoto | 49/403 |
| 4,049,038 | 9/1977 | Hyman et al. | 160/166 A |
| 4,276,954 | 7/1981 | Romano | 160/236 X |
| 4,905,828 | 3/1990 | Dods | 206/335 |
| 4,911,220 | 3/1990 | Hiller | 160/236 |
| 4,930,562 | 6/1990 | Goodman | 160/236 |
| 5,105,870 | 4/1992 | Merjane | 160/236 |
| 5,141,042 | 8/1992 | Schwaegerle | 160/236 |
| 5,269,361 | 12/1993 | Ryden et al. | 160/236 |
| 5,271,447 | 12/1993 | Aronovich | 160/236 |
| 5,303,507 | 4/1994 | Oille | 49/403 X |
| 5,350,058 | 9/1994 | Keough | 206/45.34 |
| 5,358,024 | 10/1994 | Schwaegerle | 160/236 |

*Primary Examiner*—Philip C. Kannan
*Attorney, Agent, or Firm*—Lisa L. B. Yociss

[57] ABSTRACT

A louver assembly is disclosed. The louver assembly includes a louver, a pair of generally L-shaped side flanges formed on the louver, a cover overlaying the louver, and a cap secured to the cover and the louver. The side flanges are formed on either side of the louver and extend inwardly toward one another over a front face of the louver. Opposing sides of the cover are received within the side flanges, thus forming a cavity between the cover and the louver. The cap surrounds both the cover and the louver, enclosing the cavity.

12 Claims, 4 Drawing Sheets

LOUVER ASSEMBLY WITH COVER AND CAP

BACKGROUND OF THE INVENTION

1. Technical Field

The present invention relates to a window covering system including a plurality of louvers, and in particular to a louver assembly including a louver, a cover, and a cap for enclosing a cavity formed between the louver and the cover.

2. Description of the Related Art

Vertical blinds which include a plurality of louvers and a louver support system are well known. Such blinds are typically used as a window covering to block light and for aesthetic appeal. In order to permit a user to customize the appearance of the blinds, some systems permit a user to cover the louvers with material or wallpaper.

For example, U.S. Pat. No. 4,049,038, issued to Hyman, describes a louvered covered system whereby a user may select a decorative wallpaper which is glued to a stiff backing sheet. The stiff backing sheet is then glued to the louver. The louver includes flanges on either side which receive and hold the stiff backing sheet.

Another example is U.S. Pat. No. 5,105,870, issued to Merjane. Merjane describes blind slats which include two thin transparent parts. These two parts snap together to allow the insertion of a decorative strip between the parts. Both parts are slightly concave. By forming one part with a slightly greater concavity, a very small space is created between the two parts, thus causing one of the parts to grip the other. Within this small space, a decorative strip may be held. One of the parts may be clear so that the decorative strip may be viewed through the clear part.

U.S. Pat. No. 5,269,361, issued to Ryden, is another example of a slat for a window blind. Ryden discloses a slat having a backing, an end piece, and a decorative insert. Side flanges are disposed along each side of the backing and receive and hold the decorative insert. The end piece includes a flange which extends inwardly over the end edge of the backing, and which holds the decorative insert in place. Opaque strips are secured on top of the side flanges and end flange.

SUMMARY OF THE INVENTION

A louver assembly is disclosed. The louver assembly includes a louver, a pair of generally L-shaped side flanges formed along sides of the louver, a cover overlaying the louver, and a cap secured to the cover and the louver. The side flanges are formed on either side of the louver and extend inwardly toward one another over a front face of the louver. Opposing sides of the cover are received within the side flanges, thus forming a cavity between the cover and the louver. The cover may be transparent so that the cavity may be viewed. The cap surrounds both the cover and the louver, enclosing the cavity. An insert may be included within the cavity which has a pair of opposing sides and which is shaped and sized similarly to the louver. The sides of the insert are received within the side flanges so that the insert overlays the front face of the louver, and the cover overlays the insert. A decorative object may be secured to the insert, and viewed through the cover.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
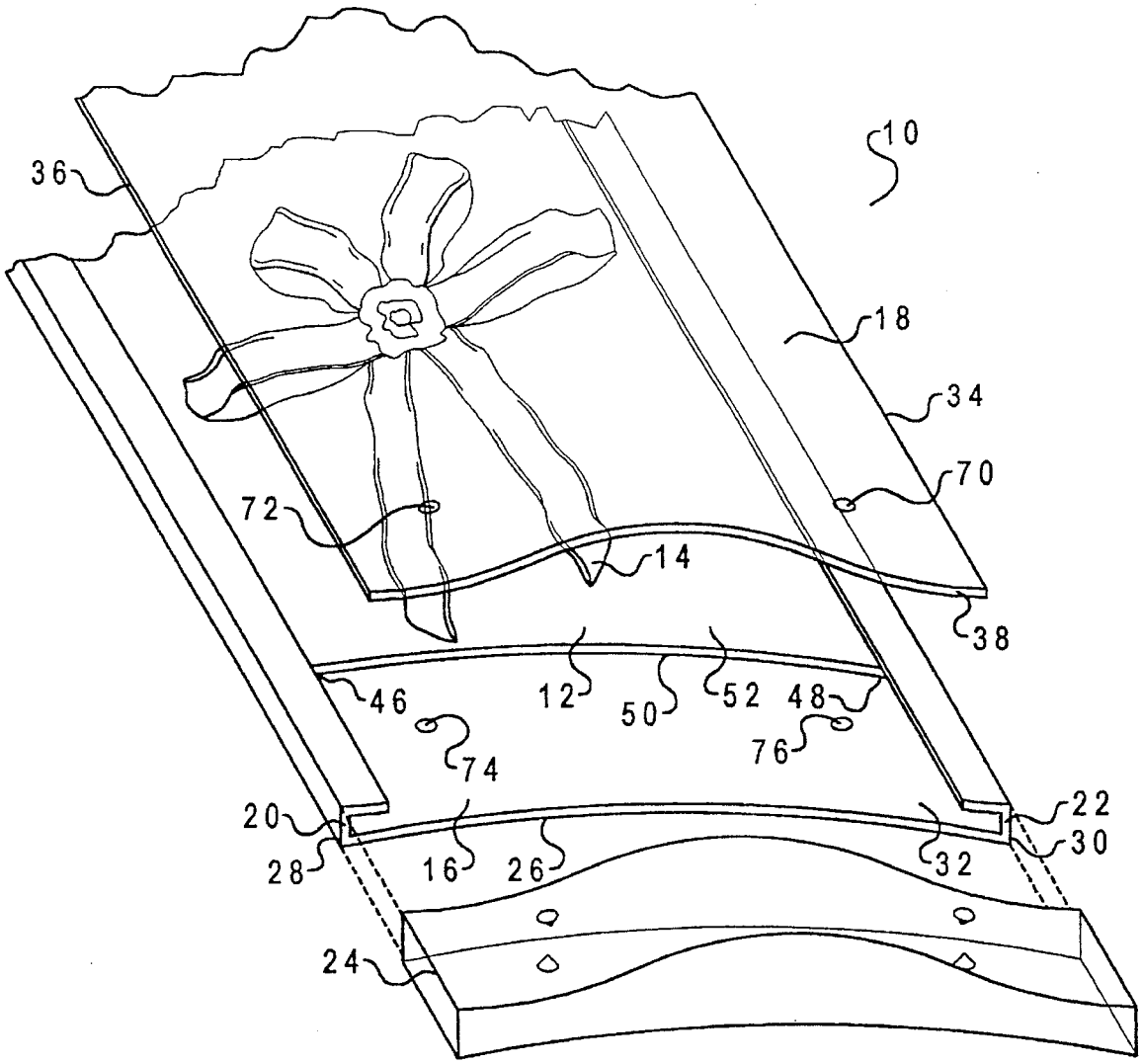
FIG. 1 is an exploded view of a louver assembly including an insert and decorative object in accordance with the present invention.
Figure 2:
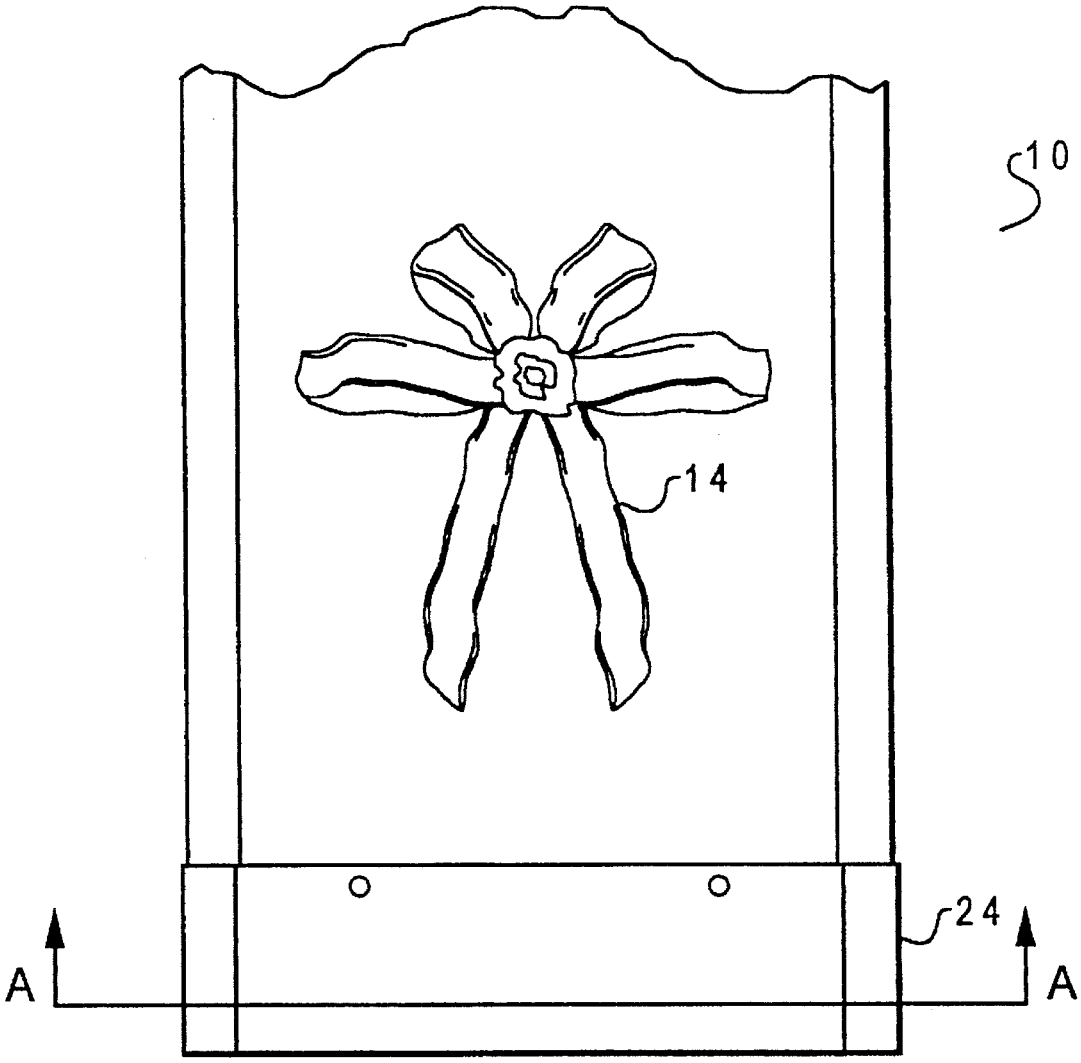
FIG. 2 is a front view of a louver assembly including an insert and decorative object in accordance with the present invention.

With reference now to the figures and in particular with reference to FIGS. 1 and 2, there is depicted an exploded and front view of a louver assembly 10 including an elongate insert 12 and decorative object 14 in accordance with the present invention. Louver assembly 10 further includes an elongate louver 16, an elongate cover 18, side flanges 20 and 22, and a cap 24. In a preferred embodiment, louver 16, insert 12, and side flanges 20 and 22 are formed from a polyvinyl chloride (PVC). Cover 18 and cap 24 may be any type of suitable plastic material, preferably a clear plastic. Cap 24 is formed from a plastic such as would permit a slight, and temporary disfigurement of the shape of cap 24 only during the time cap 24 is being secured to louver 16 and cover 18.

Louver 16 includes at least one end 26, sides 28 and 30, and a front face 32. Side flange 20 is integrally formed on side 28 of louver 16, and side flange 22 is integrally formed on side 30 of louver 16. Side flanges 20 and 22 are generally L-shaped. Side flange 20 extends inwardly toward side flange 22 over front face 32.

Cover 18 includes sides 34 and 36 and at least one end 38. Cover 18 is slidingly received by side flanges 20 and 22. Side 34 is received within side flange 22, and side 36 is received within side flange 20. Side flanges 20 and 22 prohibit lateral movement of cover 18 when cover 18 is received within side flanges 20 and 22. In this manner, cover 18 overlays louver 16, thus forming a cavity 44 (see FIG. 3).

Figure 3:
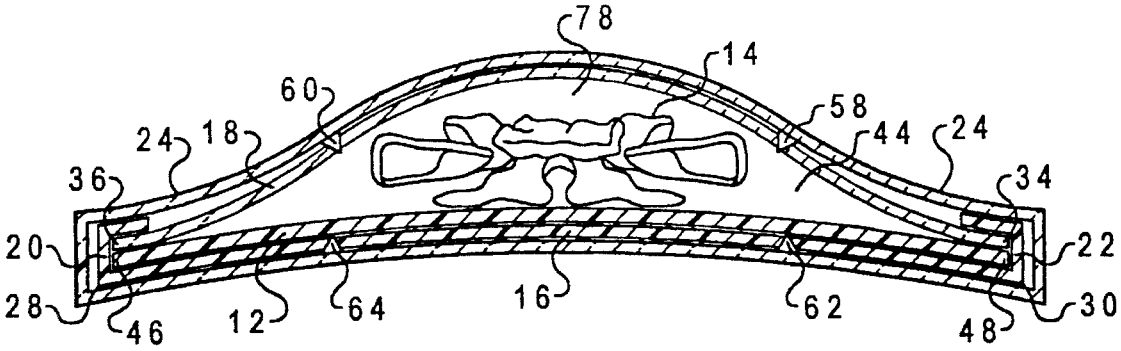
FIG. 3 is a side sectional view of a louver assembly including an insert and decorative object taken along line A—A in accordance with the present invention.

Now referring to FIG. 3, there is illustrated a side sectional view of louver assembly 10 including insert 12 and decorative object 14 taken along line A—A (see FIG. 2) in accordance with the present invention. Insert 12 is shaped and sized similarly to louver 16. Both insert 12 and louver 16 are slightly concave. Cover 18 is also concave. The concavity of cover 18 is much greater than the concavity of either louver 16 or insert 12. Therefore, when cover 18 is received by side flanges 20 and 22, cavity 44 is generally crescent-shaped.

Insert 12 includes sides 46 and 48, and at least one end 50. Insert 12 is slidingly received within cavity 44 by side flanges 20 and 22. Side 46 of insert 12 is received within side flange 20, and side 48 is received within side flange 22. Side flanges 20 and 22 prohibit lateral movement of insert 12 when insert 12 is received by side flanges 20 and 22. In this manner, insert 12 overlays front face 32 of louver 16, and cover 18 overlays insert 12.

Decorative object 14 is secured to a front face 52 of insert 12 and may be viewed through cover 18. Of course those skilled in the art will recognize that any number of decorative objects 14 may be secured to insert 12. In addition, a variety of different types of decorative objects may be secured to insert 12. Decorative object 14 may be any type of wallpaper or material. In addition, decorative object 14 may be any type of small or medium sized object which a user may select to have displayed with louver assembly 10. Those skilled in the art will recognize that decorative object 14 may include several objects displayed on one louver 16. For example, decorative object 14 may be baby diaper pins, toy cars, or decorative bows distributed along louver 16. Decorative object 14 may weigh up to approximately five (5) pounds with maximum width of approximately one (1) inch.

Therefore, the size of cavity 44 must vary according to the size of decorative object 14. When decorative object 14 is very large, the concavity of cover 18 must necessarily be much greater than louver 16 or insert 12 to create a cavity 44 having sufficient size within which to display decorative object 14. Louver 16 and insert 12 have approximately the same concavity. When decorative object 14 is smaller, the concavity of cover 18 does not need to be as large. Consequently, cavity 44 need not be as large to accommodate decorative object 14. The width of cavity 44 may be approximately one (1) inch at its widest point as illustrated at 78.

Figure 4:
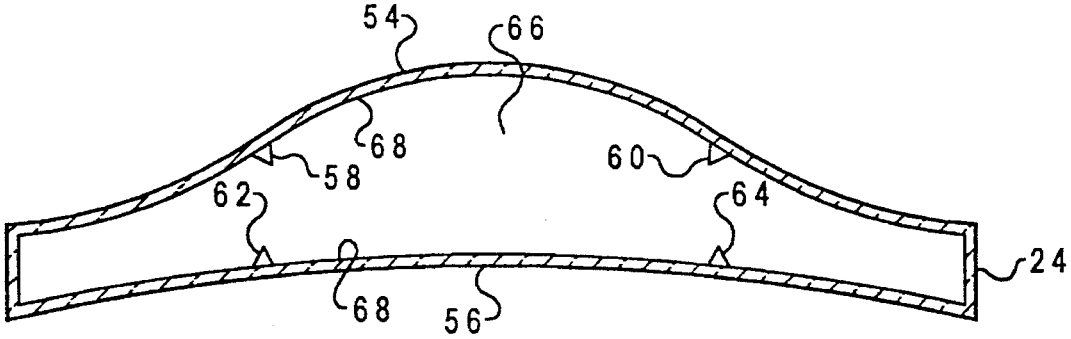
FIG. 4 is a side perspective view of a cap included within a louver assembly in accordance with the present invention.

Now referring to FIG. 4, there is depicted a side perspective view of cap 24 included within louver assembly 10 in accordance with the present invention. Cap 24 includes a top 54, a bottom 56, depending members 58, 60, 62, and 64, interior cavity 66, and interior surface 68. Members 58, 60, 62, and 64 depend generally perpendicularly from interior surface 68 of cap 24 into interior cavity 66. Cap 24 surrounds end 38 of cover 18 and end 26 of louver 16 to enclose cavity 44. Those skilled in the art will recognize that a second cap may be included at the other end of louver 16 and cover 18 (other end of louver and cover not shown). When insert 12 is included within louver assembly 10, cap 24 surrounds end 38 of cover 18, end 50 of insert 12, and end 26 of louver 16 to enclose cavity 44. Ends 26, 38, and 50 rest against cap 24 which prohibits longitudinal movement of louver 16, insert 12, and cover 18 and provides an aesthetically pleasing finished look to louver assembly 10.

Cap 24 is secured to cover 18 and louver 16. Cover 18 includes holes 70 and 72 which go completely through cover 18. Holes 70 and 72 are located near end 38 of cover 18. Louver 16 includes holes 74 and 76 which go completely through louver 16. Holes 74 and 76 are located near end 26 of louver 16. Members 58, 60, 62, and 64 of cap 24 are received within holes 70, 72, 74, and 76, respectively, thus securing cap 24 to cover 18 and louver 16.

Figure 5:
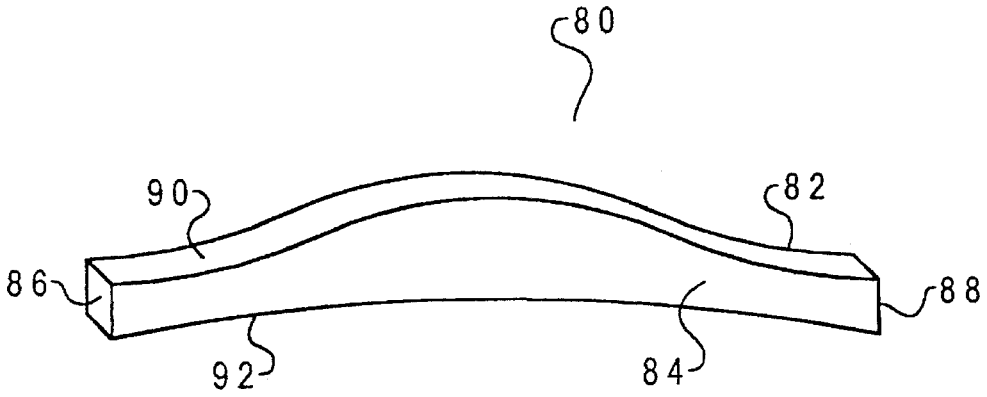
FIG. 5 is a perspective view of a platform included within a louver assembly in accordance with the present invention.

FIG. 5 is a perspective view of a platform 80 included within a louver assembly in accordance with the present invention. Platform 80 is crescent-shaped and includes a top 82, a bottom 84, two sides 86 and 88, a front 90, and a back 92. When platform 80 is included within louver assembly 10, sides 86 and 88 are received within side flanges 20 and 22, respectively. Platform 80 may be included within cavity 44 and secured either to louver 16 and cover 18, or, if insert 12 is included within louver assembly 10, platform 80 may be secured to insert 12 and cover 18. In a preferred embodiment, platform 80 includes an adhesive on top 82, bottom 84, two sides 86 and 88, front 90, and back 92. The adhesive is preferably glue. In this manner, platform 80 is adhesively secured to cover 18, side flanges 20 and 22, and to either louver 16 or insert 12.

Figure 6:
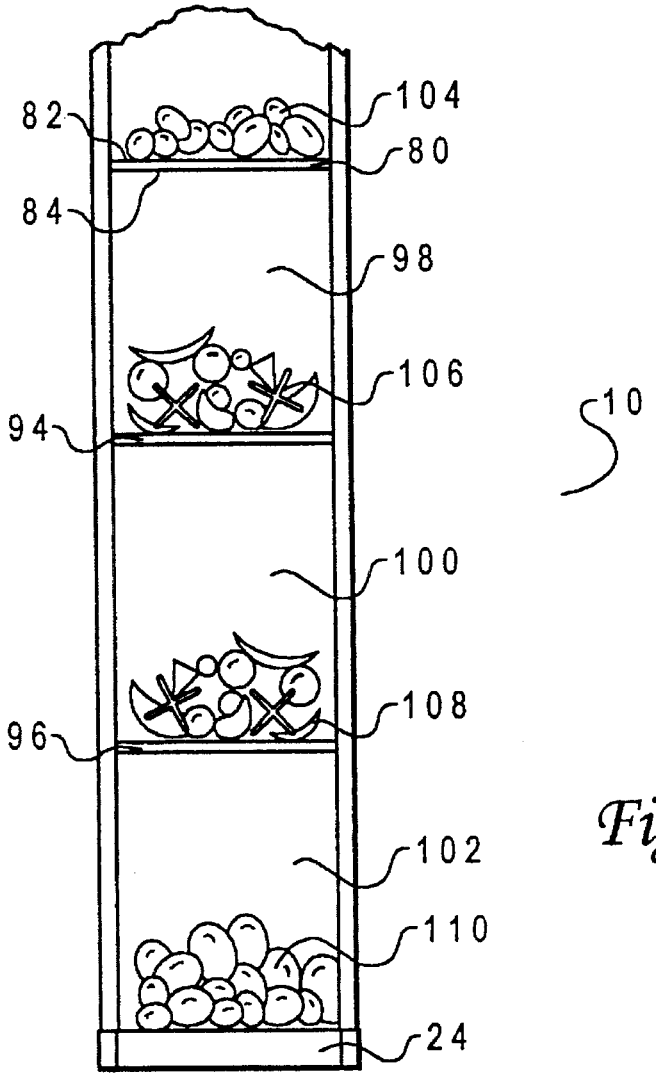
FIG. 6 is a front view of a louver assembly including multiple platforms in accordance with the present invention.

FIG. 6 is a front view of a louver assembly 10 including multiple platforms 80, 94, and 96 in accordance with the present invention. When platforms 80, 94, and 96 are included, cavity 44 is separated into multiple display cavities 98, 100, and 102. Display cavities 98, 100, and 102 are the same shape as cavity 44. In this manner, a variety of decorative objects, such as decorative objects 104 and 106, may rest on platforms 80, 94, and 96. Decorative objects 110 may rest on cap 24.

In operation, decorative object 14 is secured to front face 52 of insert 12. Insert 12 is then inserted into and slidingly received by side flanges 20 and 22 of louver 16 so that insert 12 rests against front face 32 of louver 16. Decorative object 14 is visible. Cover 18 is then slidingly received by side flanges 20 and 22. In this manner, cavity 44 is formed between louver 16 and cover 18, including insert 12 within cavity 44. Because cover 18 has a larger concavity than louver 16 and insert 12, cavity 44 is generally crescent-shaped. Cap 24 is then secured to louver 16 and cover 18 by slightly disfiguring cap 24 so as to permit depending members 58, 60, 62, and 64 to slide along louver 16 and cover 18 and be received within holes 70, 72, 74, and 76, respectively. Once members 58, 60, 62, and 64 are received within holes 70, 72, 74, and 76, cap 24 once again regains its original shape.

The invention has significant advantages. A large variety of decorative objects may be included within the louver assembly, thus permitting a user to customize the appearance of the louvers. In prior systems, any decorative objects that were utilized were typically wallpaper, or cloth material because the prior systems could not support a heavy or large decorative object. The present invention permits a user to select from a wider variety of objects, including small toys, for display.

In addition, the cap provides a finished look to the louver, as well as a support for the insert and cover. The cap is shaped so as to enclose the cavity formed between the cover and the louver. The members provided inside the cap fit securely into the holes in the cover and the louver, thus securing the cap to the cover and the louver. In this manner, the decorative object is completely enclosed within the cavity to prohibit its removal. When a platform is included, the appearance of the louver assembly may be further customized by the addition of decorative objects which rest on the platform.

While the invention has been particularly shown and described with reference to a preferred embodiment, it will be understood by those skilled in the art that various changes in form and detail may be made therein without departing from the spirit and scope of the invention.

I claim:

1. A louver assembly comprising:

an elongate louver having a front face, at least one end, and two opposing sides;

a pair of generally L-shaped side flanges, a first of said side flanges integrally formed on a first of said two opposing sides of said louver and a second of said side flanges integrally formed on a second of said two opposing sides of said louver, said first and said second side flanges extending inwardly toward one another over said front face of said louver;

an elongate cover overlaying said louver and having a pair of opposing sides and at least one end, a first of said sides of said cover being received within said first of said side flanges and a second of said sides of said cover being received within said second of said side flanges, wherein a cavity is formed between said cover and said louver; and a cap secured to said cover and said louver, and surrounding said at least one end of said louver and said at least one end of said cover for enclosing said cavity; and an elongate insert having a pair of opposing sides and being shaped and sized similarly to said louver, a first of said sides of said insert being received within said first of said side flanges and a second of said sides of said insert being received within said second of said side flanges, wherein said insert overlays said louver and said cover overlays said insert, further wherein said insert is included within said cavity.

2. The louver assembly according to claim 1 wherein said cover is transparent.

3. The louver assembly according to claim 1 further comprising decorative object secured to said insert, wherein said decorative object is viewed through said cover.

4. The louver assembly according to claim 3 wherein said decorative object is a three-dimensional decorative bow.

5. The louver assembly according to claim 3 wherein said decorative object has a width of one inch.

6. A louver assembly comprising:

an elongate louver having a front face, at least one end, and two opposing sides;

a pair of generally L-shaped side flanges, a first of said side flanges integrally formed on a first of said two opposing sides of said louver and a second of said side flanges integrally formed on a second of said two opposing sides of said louver, said first and said second side flanges extending inwardly toward one another over said front face of said louver;

an elongate cover overlaying said louver and having a pair of opposing sides and at least one end, a first of said sides of said cover being received within said first of said side flanges and a second of said sides of said cover being received within said second of said side flanges, wherein a cavity is formed between said cover and said louver; and a cap secured to said cover and said louver, and surrounding said at least one end of said louver and said at least one end of said cover for enclosing said cavity said cover including a plurality of holes through said cover and located near said at least one end of said cover;

said louver including a plurality of holes through said louver and located near said at least one end of said louver; and said cap including an interior cavity, an interior surface, and a plurality of members depending generally perpendicularly from said interior surface extending partially into said interior cavity of said cap, said plurality of members being received within said plurality of holes through said cover and said plurality of holes through said louver, wherein said cap is secured to said cover and said louver.

7. A louver assembly comprising:

an elongate, concave louver having a front face, at least one end, and two opposing sides;

a pair of generally L-shaped side flanges, a first of said side flanges integrally formed on a first of said two opposing sides of said louver and a second of said side flanges integrally formed on a second of said two opposing sides of said louver, said first and said second side flanges extending inwardly toward one another over said front face of said louver;

an elongate, concave cover overlaying said louver and having a pair of opposing sides and at least one end, a first of said sides of said cover being received within said first of said side flanges and a second of said sides of said cover being received within said second of said side flanges, wherein a generally crescent-shaped cavity is formed between said cover and said louver; and a cap secured to said cover and said louver, and surrounding said at least one end of said louver and said at least one end of said cover for enclosing said cavity.

8. The louver assembly according to claim 7 wherein a width of said cavity at a widest point of said cavity is one inch.

9. The louver assembly according to claim 8 wherein a concavity of said cover is greater than a concavity of said louver.

10. A louver assembly comprising:

an elongate concave louver having a front face, at least one end, and two opposing sides;

a pair of generally L-shaped side flanges, a first of said side flanges integrally formed on a first of said two opposing sides of said louver and a second of said side flanges integrally formed on a second of said two opposing sides of said louver, said first and said second of said side flanges extending inwardly toward one another over said front face of said louver;

an elongate concave cover overlaying said louver and having a pair of opposing sides and at least one end, a first of said sides of said cover being received within said first of said side flanges and a second of said sides of said cover being received within said second of said side flanges, a concavity of said cover being greater than a concavity of said louver, wherein a crescent-shaped cavity is formed between said cover and said louver;

an elongate concave insert having a pair of opposing sides and being shaped and sized similarly to said louver, a first of said sides of said insert being received within said first of said side flanges and a second of said sides of said insert being received within said second of said side flanges, wherein said insert overlays said louver and said cover overlays said insert, further wherein said insert is included within said cavity;

a decorative object secured to said insert, wherein said decorative object is viewed through said cover; and a cap secured to said cover and said louver, and surrounding said at least one end of said louver and said at least one end of said cover for enclosing said cavity, wherein said cover, said insert, and said louver are supported by said cap.

11. The louver assembly according to claim 10 further comprising:

said cover including a plurality of holes through said cover and located near said at least one end of said cover;

said louver including a plurality of holes through said louver and located near said at least one end of said louver; and said cap including an interior cavity, an interior surface, and a plurality of members depending generally perpendicularly from said interior surface extending partially into said interior cavity of said cap, said plurality of members being received within said plurality of holes through said cover and said plurality of holes through said louver, wherein said cap is secured to said cover and said louver.

12. A louver assembly comprising:

an elongate louver having a front face, at least one end, and two opposing sides;

a pair of generally L-shaped side flanges, a first of said side flanges integrally formed on a first of said two opposing sides of said louver and a second of said side flanges integrally formed on a second of said two opposing sides of said louver, said first and said second of said side flanges extending inwardly toward one another over said front face of said louver;

an elongate cover overlaying said louver and having a pair of opposing sides and at least one end, a first of said sides of said cover being received within said first of said side flanges and a second of said sides of said cover being received within said second of said side flanges, wherein a cavity is formed between said cover and said louver;

an elongate insert having a pair of opposing sides and being shaped and sized similarly to said louver, a first of said sides of said insert being received within said first of side flanges and a second of said sides of said insert being received within said second of side flanges, wherein said insert overlays said louver and said cover overlays said insert, further wherein said insert is included within said cavity;

a cap secured to said cover and said louver, and surrounding said at least one end of said louver and said at least one end of said cover for enclosing said cavity, wherein said louver, said cover, and said insert are supported by said cap;

said cover including a plurality of holes through said cover and located near said at least one end of said cover;

said louver including a plurality of holes through said louver and located near said at least one end of said louver; and said cap including an interior cavity, an interior surface, and a plurality of members depending generally perpendicularly from said interior surface extending partially into said interior cavity of said cap, said plurality of members being received within said plurality of holes through said cover and said plurality of holes through said louver, wherein said cap is secured to said cover and said louver.

* * * * *